US006220490B1

(12) United States Patent
O'Hara

(10) Patent No.: US 6,220,490 B1
(45) Date of Patent: Apr. 24, 2001

(54) DRINKING VEST

(76) Inventor: Robert J. O'Hara, P.O. Box 139, Dover, DE (US) 19903

( * ) Notice: Subject to any disclaimer, the term of this patent is extended or adjusted under 35 U.S.C. 154(b) by 0 days.

(21) Appl. No.: 09/420,840

(22) Filed: Oct. 19, 1999

Related U.S. Application Data

(60) Provisional application No. 60/120,754, filed on Feb. 18, 1999.

(51) Int. Cl.[7] ..... A45F 3/16

(52) U.S. Cl. ..... 224/148.2; 224/148.3; 224/637; 2/102; 2/108; 2/458; 2/900; 222/175

(58) Field of Search ..... 224/148.1, 148.2, 224/148.3, 148.4, 148.5, 148.6, 601, 602, 627, 637; 2/900, 458, 94, 102, 108; 222/175

(56) References Cited

U.S. PATENT DOCUMENTS

| | | | | |
|---|---|---|---|---|
| 2,013,358 | | 9/1935 | Osborne . | |
| 4,095,726 | * | 6/1978 | Hechler, IV et al. | 222/175 |
| 4,420,097 | | 12/1983 | Motsenbocker . | |
| 4,544,087 | | 10/1985 | Modig . | |
| 4,948,023 | | 8/1990 | Tripp . | |
| 5,060,833 | | 10/1991 | Edison et al. . | |
| 5,085,349 | | 2/1992 | Fawcett . | |
| 5,427,290 | | 6/1995 | Thatcher . | |
| 5,465,885 | | 11/1995 | Wyatt . | |
| 5,586,703 | * | 12/1996 | Radar et al. | 224/601 |
| 5,722,573 | | 3/1998 | Carnel . | |
| 5,803,333 | * | 9/1998 | Fawcett | 224/652 |
| 5,864,880 | * | 2/1999 | Adam | 2/94 |
| 5,901,889 | * | 5/1999 | Ho | 224/148.2 |
| 5,940,880 | * | 8/1999 | Phillips | 224/148.2 X |
| 5,957,348 | * | 9/1999 | Foreman | 224/148.1 |

FOREIGN PATENT DOCUMENTS

| | | |
|---|---|---|
| 275131 | 5/1951 | (CH) . |
| 0062028 | 10/1982 | (EP) . |

* cited by examiner

*Primary Examiner*—Stephen K. Cronin
(74) *Attorney, Agent, or Firm*—Richard C. Litman

(57) ABSTRACT

A portable holder for holding drinking liquid in the shape of a vest, having front and back sections with tubing that can be filled with drinking liquid; a twist lock coupler drains from the back to the front. Each section has molded sinuous tubing that can be filled by a filling tube and vented from the same filling tube at the top of the vest. Each section is also held together on the side by a hook and loop fastener. The vest also allows the wearer to drink through a drinking tube while wearing the vest. There is also a drainage tube provided by the vest with a screw cap that is concealed by a tongue and groove fastener. Each section is also held together on the other side of the vest by a hook and loop fastener.

13 Claims, 6 Drawing Sheets

DRINKING VEST

CROSS-REFERENCE TO RELATED APPLICATION

This application claims the benefit of U.S. Provisional Patent Application Serial No. 60/120,754, filed Feb. 18, 1999.

BACKGROUND OF THE INVENTION

1. Field of the Invention

The present invention relates to a vest that holds and dispenses drinkable liquid to the person wearing the vest.

2. Description of Related Art

Portable liquid dispensers are known in the related art. Some portable liquid dispensers are strapped to an individual and allow him to drink liquids when it might not otherwise be convenient to stop the activity in which the person is engaged. Conventional harnessing arrangements for portable liquid dispensers provide for liquid dispensers which can be suspended from the shoulders, either in a knapsack configuration or with a liquid storage means being near or against the stomach of the person wearing the portable liquid dispenser.

Suspension of the liquid storing means from the shoulders may be a satisfactory means of supporting the liquid storing means during leisure activity. However, such a means of suspension is far from satisfactory during vigorous activity. The shoulder straps bear down upon the bursa, the deltoid muscles and the clavicles, and also cause compression of the tissues associated with the neck and the shoulders. This pressure restricts blood flow and may also cause pressure on the nerves leading to the upper limbs. Friction between the straps and the skin because of continuous movement of the bursa, deltoid, trapezia and the splenius muscles in this region, as a result of vigorous exercise, may cause intense chafing of the skin. Attempts have been made to attend to this chafing. For instance, shoulder pads have been provided between the straps and the skin. These pads have proven unsatisfactory, because they do not position well on the shoulders, are displaceable, and in many instances merely transfer points of chafing.

In vigorous exercise, e.g., canoeing and long distance running, liquid storage means near or against the stomach restrict free movement of the muscles near the stomach and abdomen and cause chaffing from a bloating effect when the liquid storage means is full or near capacity.

Several related art patents disclose liquid dispensers, such as Osborne, U.S. Pat. No. 2,013,358 which describe a liquid storage dispenser which is suspended from the shoulder and Carnel, U.S. Pat. No. 5,722,573 which describe a liquid storage dispenser with a liquid storage means near the wearer's stomach. The related art discloses liquid dispenser means creating pressure points on the body where the liquid storage means is suspended and allowing the liquid contents of the liquid storing means to be irregularly displaced. This can clearly cause a lot of discomfort.

None of the above inventions and patents, taken either singly or in combination, is seen to describe the instant invention as claimed.

SUMMARY OF THE INVENTION

The invention is a portable holder for drinking liquid in the shape of a vest. The vest has a front section and back section with tubing filled with drinking liquid, the tubing of the front and rear sections being connected by a twist lock coupler; liquid drains from the back of the vest to the front of the vest. Each section has molded sinuous tubing that can be filled and vented from the top of the vest. The vest also allows the wearer to drink the drinking liquid through a drinking tube while wearing the vest. There is also a drainage tube on the vest provided with a screw cap that is concealed by a tongue and groove fastener. Each section is also held together on the side of the vest by a hook and loop fastener.

Accordingly, it is a principal object of the invention to provide a portable holder for drinking liquid in the shape of a vest.

It is an object of the invention to provide a vest-configured drink holder made of front and back sections, with tubing for liquid in each section, the tubing of one section connected to the tubing of the other by a quick disconnect coupling.

It is a further object of the invention to provide a vest-configured drink holder which is dimensioned and configured to be comfortably worn and does not chafe the wearer's skin.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
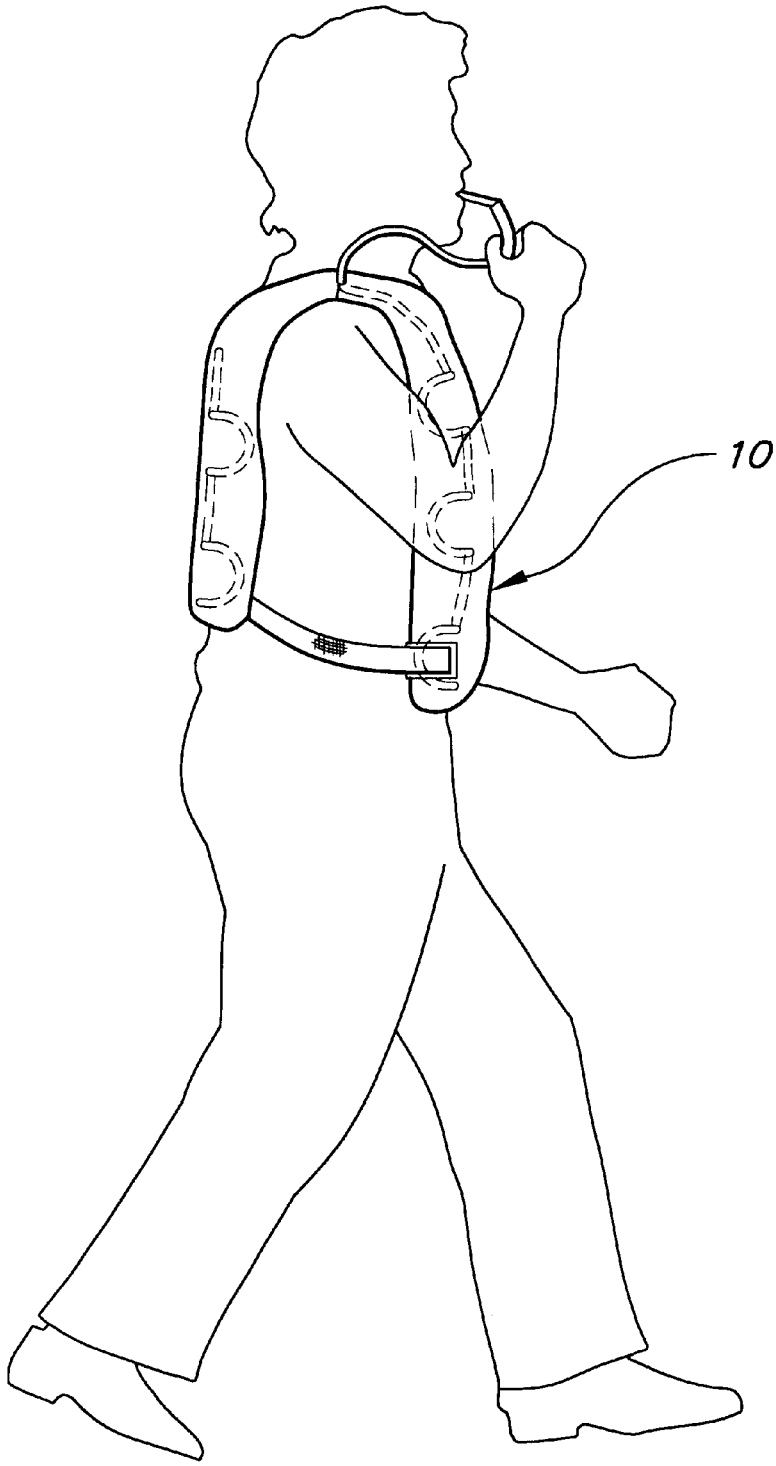
FIG. 1 is an environmental, perspective view of a drinking vest according to the present invention.

The present invention is a vest 10 that holds and dispenses drinkable liquid to the person wearing the vest 10, as illustrated in FIG. 1. The vest 10 is made of an exterior layer and an interior layer, with internal molded sinuous tubing for holding drinkable liquid kept between the exterior layer and interior layer of the vest 10. The exterior and interior layers of the vest 10 are made of smooth, thermoplastic insulating material. This helps to prevent the temperature of the drinking liquid from affecting the comfort of the wearer, and prevents the wearer's body heat from effecting the drinking liquid.

An exterior shell is also present which is easily removable from the vest 10 and goes over the interior layer, exterior layer and sinuous tubing. The exterior shell comes in a variety of aesthetic designs, such as an incandescent and reflective design or a camouflage design depending on the specific activity and taste of the wearer. The incandescent and reflective design is usually worn by athletes such as runners and cyclists and the camouflage design is worn by hunters. The exterior shell is also made of canvas or nylon.

Figure 2:
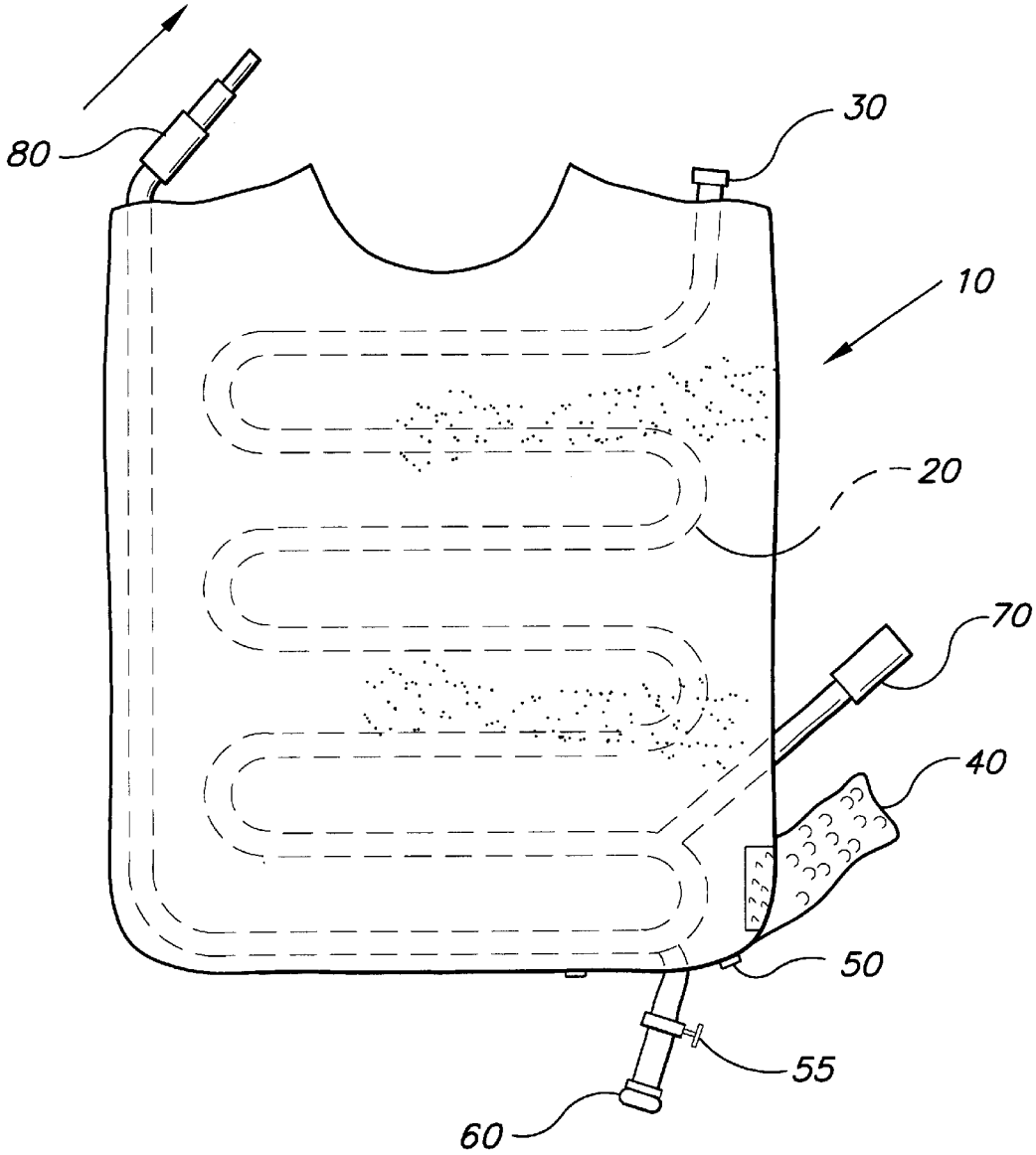
FIG. 2 is a front elevational view of the drinking vest shown in FIG. 1, and drawn to an enlarged scale.
Figure 9:
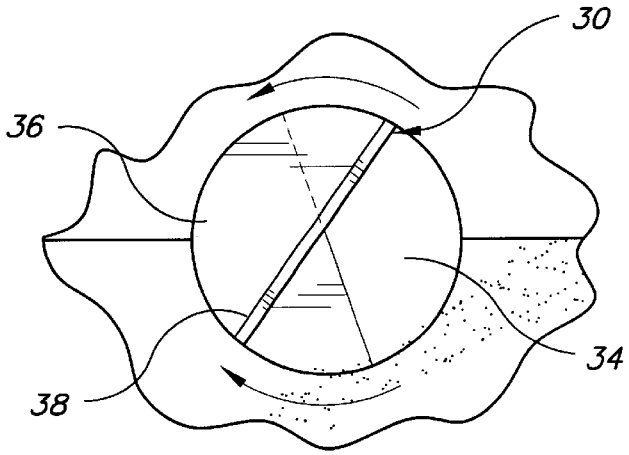
FIG. 9 is a detail view of the vest air vent and fill hole.

Molded sinuous tubing 20 is provided throughout the front of the vest 10, which is shown in FIG. 2. A filling means for filling the vest 10 with drinking liquid is also provided. The filling means is a screw cap 30, a fill hole orifice 38 and a funnel (not shown). The screw cap 30 is removed and a funnel is inserted into the fill hole orifice 38. The drinking liquid is then poured into the vest 10 through the funnel and fill hole orifice 38 and into the molded sinuous tubing 20 of the vest. The screw cap 30 can be inserted back into the fill hole orifice 38 when the user is done filling the vest 10. The screw cap 30 will then allow air flow during usage to avoid a vacuum in the molded sinuous tubing 20. As shown in FIG. 9, the screw cap 30 can be rotated by pinching the screw cap 30 and rotating the open section 34 of the screw cap 30 over the fill hole orifice 38. The fill hole orifice 38 can then be closed by rotating the closed section 36 over the fill hole orifice 38 to obstruct the flow of air from the fill hole orifice 38.

Figure 3:
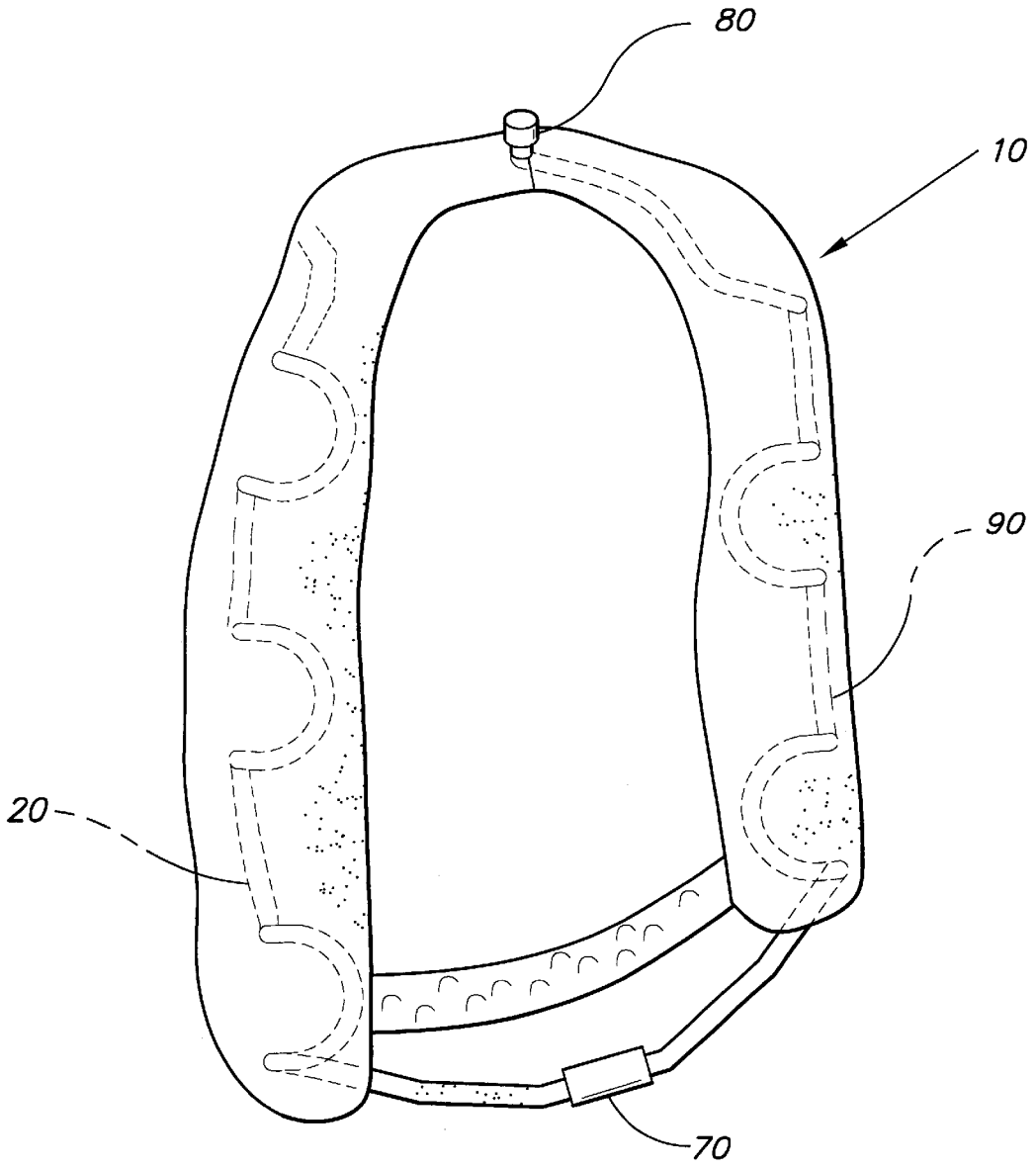
FIG. 3 is a left side elevational view of the drinking vest.
Figure 7:
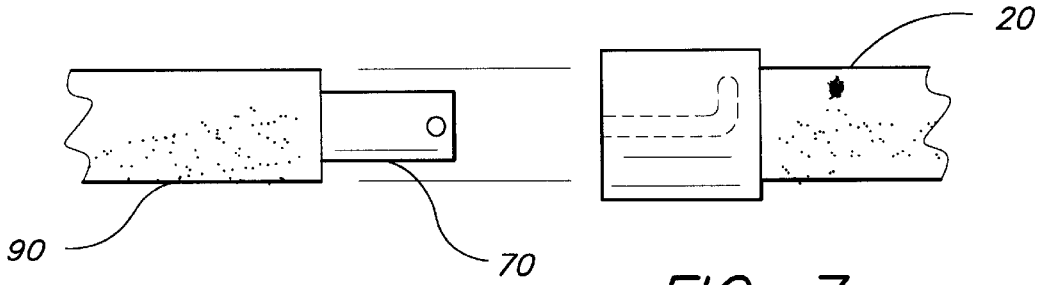
FIG. 7 is an exploded view of a twist lock coupler for the drinking vest.

There is also a fastening means 40 between the front and the back of the vest 10. The fastening means 40 is a hook and loop fastener which attaches the front of the vest 10 with the back of the vest 10. On a side of the vest 10 is a twist lock coupler 70 for attaching the molded sinuous tubing in the back of the vest 90 with the molded sinuous tubing in front of the vest 20. The coupler is illustrated in detail in FIG. 7. The front of the vest 10 is longer than the back of the vest 10 to allow the drinking liquid to gravitationally drain from the back of the vest 10 to the front of the vest 10. This is shown in FIG. 3 along with a view of the twist lock coupler 70.

Figure 8:
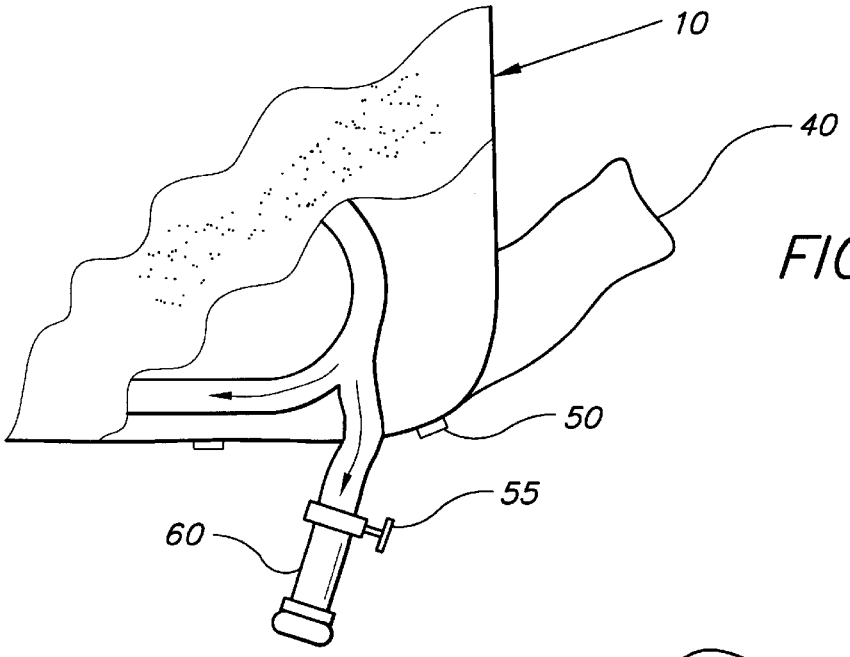
FIG. 8 is a detail view of the vest drainage tube.

An enclosing means for enclosing the drainage tube 60 and screw top 55 is shown in FIG. 8. The enclosing means is a tongue and groove fastener 50 which provides access to the drainage tube 60 and screw top 55 near the bottom of the vest 10. When the screw top 55 is in the closed position, it blocks the flow of drinking liquid to the drainage tube 60 and holds the drinking liquid within the molded sinuous tubing 20,90. When the screw top 55 is in the open position, it allows the drinking liquid to flow through the drainage tube 60 and out of the vest 10.

The screw top 55 is normally in the closed position while the vest 10 is being worn or used. The screw top 55 is in the open position when the user wants to clean out the vest 10 by running water or a cleaning solution through the molded sinuous tubing 20,90, and allowing the water or cleaning solution to drain out through the drainage tube 60.

Figure 4:
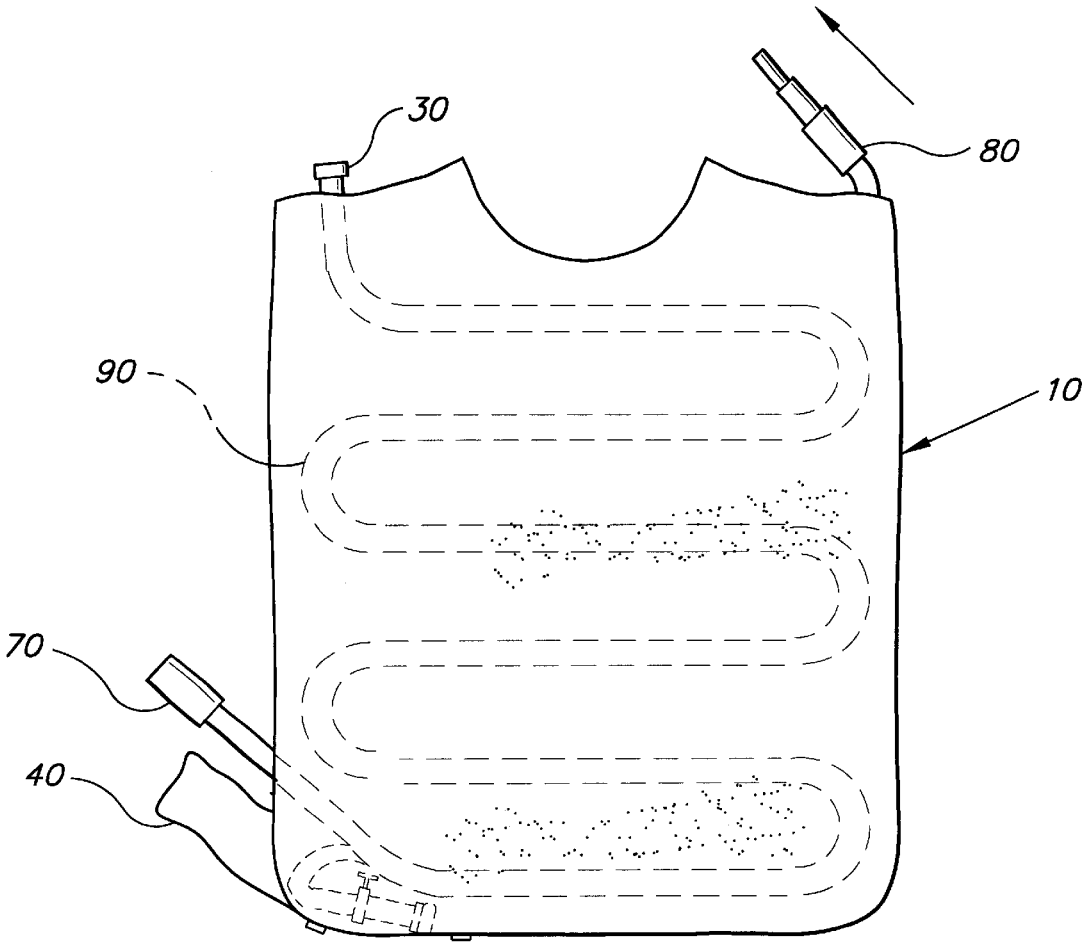
FIG. 4 is a rear elevational view of the drinking vest.
Figure 5:
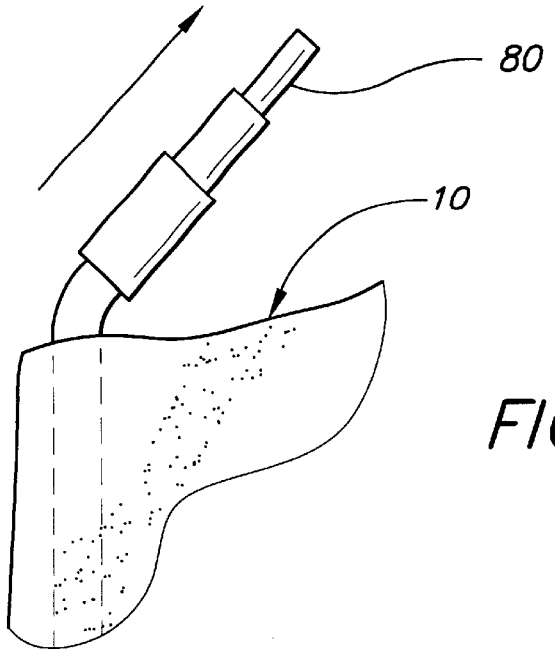
FIG. 5 is a detail view of the telescoping drinking tube for the drinking vest.

There is also a dispensing means for dispensing drinkable liquid to the person wearing the vest 10. The dispensing means of the preferred embodiment is a telescoping drinking tube 80 extending from the shoulder of the vest 10, as shown in FIGS. 4 and 5. The telescoping drinking tube 80 can be pulled out and extended to allow the user to suck drinking liquid through the telescoping drinking tube 80. When the telescoping drinking tube 80 is not used, it can be compressed back down into the vest 10 until the user is ready to drink from the telescoping drinking tube 80 again.

Figure 6:
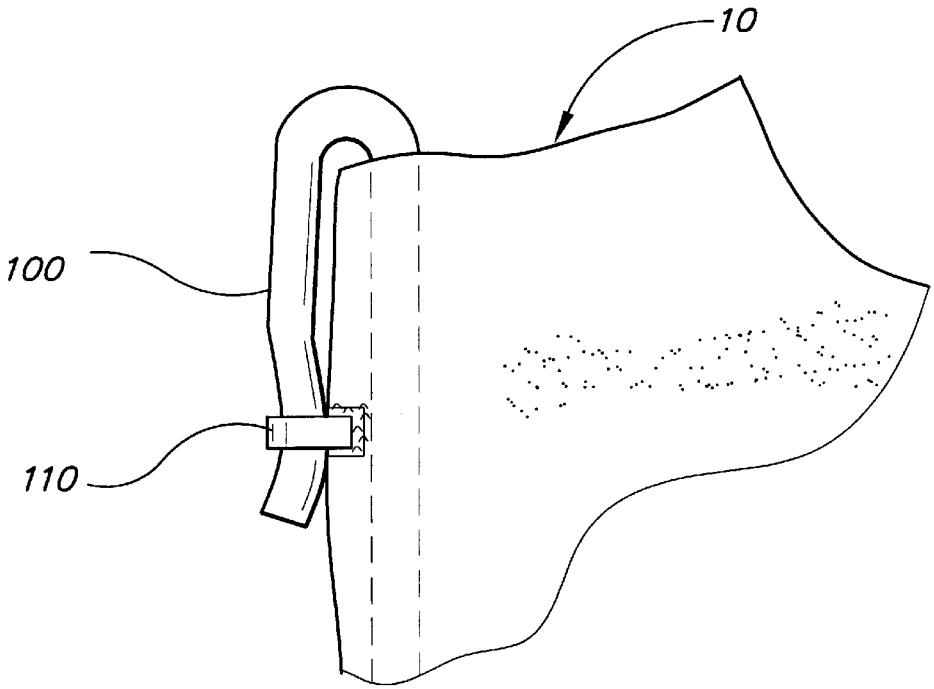
FIG. 6 is a detail view of the pliable drinking tube assembly for the drinking vest.

A second dispensing means is shown in FIG. 6, where the dispensing means is a pliable drinking tube assembly 100 that is held on the side of the vest 10 with a second hook and loop fastener 110. The pliable drinking tube assembly 100 is held on the side of the vest 10 when not in use and can be released from the hook and loop fastener 110 for usage. The pliable drinking tube assembly 100 is used by sucking drinking liquid through the pliable drinking tube assembly 100 into the user's mouth.

It is to be understood that the present invention is not limited to the sole embodiment described above, but encompasses any and all embodiments within the scope of the following claims.

I claim:

1. A vest comprising:

front and back sections, each having an exterior and interior layer;

internal sinuous tubing for holding drinkable liquid kept between the exterior layers and interior layers of the vest;

a dispensing means for dispensing drinkable liquid to the person wearing the vest;

a fastening means for fastening the front section of the vest with the back section of the vest;

a filling means for filling the vest with drinking liquid and a fill hole orifice to allow air flow during usage and to avoid a vacuum in the tubing;

an exterior shell;

a drainage tube;

a screw cap valve;

an enclosing means for selectively enclosing the exterior shell of the vest and accessing said drainage tube and screw cap valve; and a connecting means between the sinuous tubing in front of the vest and the sinuous tubing in the back of the vest.

2. The vest according to claim 1, wherein exterior and interior layers are made of smooth, thermoplastic insulating material.

3. The vest according to claim 1, wherein said dispensing means is a telescoping drinking tube extending from the shoulder of the said vest.

4. The vest according to claim 1, wherein said dispensing means is a pliable drinking tube assembly, there further being hook and loop fastener means for holding the drinking tube assembly at a predetermined location on the vest.

5. The vest according to claim 1, wherein said fastening means between the front section of the vest and the back section of the vest is a hook and loop fastener.

6. The vest according to claim 1, wherein said enclosure means on the exterior shell near the drainage tube is a tongue and groove fastener.

7. The vest according to claim 1, wherein said connecting means between the front sinuous tubing and the back sinuous tubing is a twist lock coupler.

8. The vest according to claim 1, wherein said exterior shell is made of an incandescent and reflective material.

9. The vest according to claim 1, wherein said exterior shell is made of a camouflage material.

10. The vest according to claim 1, wherein said exterior shell is made of canvas.

11. The vest according to claim 1, wherein said exterior shell is made of nylon.

12. The vest according to claim 1, wherein said filling means includes a screw cap.

13. The vest according to claim 12, wherein said screw cap further includes closable vent means for allowing air flow during usage, thus to avoid a vacuum in the tubing.

* * * * *